US008079778B2

(12) United States Patent
Colkitt

(10) Patent No.: US 8,079,778 B2
(45) Date of Patent: Dec. 20, 2011

(54) GEOTEXTILE APPLICATOR DEVICE AND METHOD

(76) Inventor: Byron Kelly Colkitt, Klickitat, WA (US)

( * ) Notice: Subject to any disclaimer, the term of this patent is extended or adjusted under 35 U.S.C. 154(b) by 806 days.

(21) Appl. No.: 12/186,364

(22) Filed: Aug. 5, 2008

(65) Prior Publication Data

US 2009/0274516 A1 Nov. 5, 2009

Related U.S. Application Data

(60) Provisional application No. 61/050,019, filed on May 2, 2008.

(51) Int. Cl.
*B65H 16/06* (2006.01)

(52) U.S. Cl. ..... 404/100; 242/557; 242/566; 405/302.7

(58) Field of Classification Search ..... 242/403, 242/404.3, 557, 566; 404/100; 405/302.7
See application file for complete search history.

(56) References Cited

U.S. PATENT DOCUMENTS

| | | | | |
|---|---|---|---|---|
| 1,946,819 | A * | 2/1934 | Stevenson | 404/108 |
| 3,814,144 | A * | 6/1974 | Spencer | 140/107 |
| 4,175,496 | A * | 11/1979 | Rehbein | 111/200 |
| 4,456,399 | A | 6/1984 | Conover | |
| 4,513,530 | A * | 4/1985 | Nyboer | 47/9 |
| 4,705,427 | A * | 11/1987 | Atkins et al. | 405/36 |
| 4,793,731 | A * | 12/1988 | Gnesa | 404/83 |
| 4,861,219 | A * | 8/1989 | Mayle | 414/469 |
| 5,526,759 | A * | 6/1996 | Cox | 111/200 |
| 6,558,080 | B2 * | 5/2003 | Kozak | 405/129.9 |
| 7,018,135 | B2 * | 3/2006 | Kaul et al. | 405/129.75 |
| 7,600,949 | B2 * | 10/2009 | Ruiz | 405/302.7 |

* cited by examiner

*Primary Examiner* — Gary S Hartmann
(74) *Attorney, Agent, or Firm* — Peter A Haas Esquire LLC

(57) ABSTRACT

An improved device for simultaneously unrolling geotextile fabric and dispensing an aggregate layer for road construction comprises a hanger bar coupled to a vehicle frame. The hanger bar supports a roller bar adapted to carry a fabric roll. A dragger couples the hanger bar and arranges to present a dead-weight member on top of the fabric. An improved method using the improved device drags the chain on top of the fabric as it unrolls, thus holding the fabric in place. At the same time, a conveyered aggregate delivery system dispenses gravel on top of the fabric.

7 Claims, 12 Drawing Sheets

GEOTEXTILE APPLICATOR DEVICE AND METHOD

PRIORITY CLAIM

The present application claims benefit under 35 USC Section 119(e) of U.S. Provisional Patent Application Ser. No. 61/050,019 filed on 2 May 2008. The present application is based on and claims priority from this application, the disclosure of which is expressly incorporated herein by reference.

BACKGROUND

The present invention relates to a device adapted for use on the rear portion of an off-highway or construction vehicle to improve the unrolling of geotextile materials as commonly used in road-beds, landscaping, retention walls, pond-lining, and the like. And, more specifically, the present invention relates to a device that couples to a conveyered material placement vehicle to simultaneously and continuously dispense fabric from a roll as an aggregate is placed on top of the dispensed fabric.

Certain construction techniques for roadbeds, drainage ditches, man-made ponds and other landscaping needs require a cloth or fabric liner layer to be placed on the newly prepared and compacted soil. This cloth or fabric liner typically arrives at the construction site in large roles varying from about 3-feet to about 15-feet in width and (unfurled) having lengths of 300 feet or more for landscape rolls and about 13-feet wide or about 15-feet wide for road-bed fabric rolls, for example.

Fabric rolls used in road construction, landscaping and the like are generally known as geotextiles and are defined by the American Society for Testing and Materials (ASTM) as any permeable textile material used with foundation, soil, rock, earth as an integral part of a construction project, structure, or system and may be synthetic or natural fibers, or both. Geomembranes, also used in similar applications, are continuous membrane-type liners or barriers that have low permeability to control migration of fluid and restrict fluid flow.

In the road construction industry there are essentially four primary uses for geotextiles: separation, drainage, filtration, and reinforcement. However, most often geotextiles are used for stabilizing roads through separation and drainage. Stabilization results from the geotextile acting as a barrier to migration of fines in the subgrade to the base layer (aggregate layer), while simultaneously permitting water to migrate from the base layer to the subgrade or laterally away from the roadbed. Migration of fines is highly undesirable because it weakens the road structure.

Geotextiles are well suited for temporary road construction, particularly in environmentally sensitive areas where a biodegradable woven jute geotextile can be used. Geotextiles are economical for temporary road construction, such as construction roads in isolated areas as are needed to install power grid infrastructure, wind-turbine power generations, or remote logging roads, for example.

Such roads, for example, use a crushed aggregate layer on top of native subgrade material. A geotextile serves as a separation layer between the subgrade and the aggregate, preventing intermixing of the two layers. Intermixing occurs (absent the geotextile layer) from pressure exerted on the road from vehicles, the downward and laterally moving load creates a pump-like affect that draws fines in the subgrade upward, intermixing in the aggregate layer. This affect becomes more dramatic when there is water migration as well.

Thus, proper selection and installation of a suitable geotextile is vitally important in road construction. The installation method for geotextiles (or fabric rolls), as generally known in the art, requires shaping the roadway subgrade, rolling the fabric down the road one lane per roll, and if windy, weight the sides of the unrolled fabric with shovels full of gravel or use spikes or staples to pin the fabric down. Then, dump and spread the gravel or base course material using normal methods with an end dump truck (or belly-dump or side-dump trucks)—but making certain to avoid driving onto the geotextile with any equipment other than rubber-tired vehicles operating over a solid sub-grade in a straight line with no turns and a vehicle speed of no more than seven miles per hour or otherwise risking a puncture or tear, damaging the fabric and making it less suitable for its intended use.

Currently, the tools and methods to unroll these large fabric rolls include a hanger bar coupled to the rear of a vehicle, such as a dump truck (belly, side, or end) or a front-end loader using the bucket to suspend a roller bar and reversing to unroll the material. The hanger bar supports a roll bar adapted to slideably receive a roll of material. Then, several workers unroll a portion of the roll, stand on it, pin it, or manually shovel some aggregate (e.g. gravel) on the roll to hold it in place. Next, the vehicle advances and unrolls the fabric as the vehicle travels. To hold the fabric in place, the army of workers shovels aggregate, or use spikes to pin the fabric to the sub-grade. Only after the fabric is fully installed, then a second aggregate delivery truck (dump truck), backs to the fabric—to avoid driving on the fabric, which could rip or tear the fragile material—and then dumps the aggregate. Next, a third vehicle (bull-dozer) distributes the piled aggregate on top of the fabric. This is a tedious and time-consuming procedure that must be repeated for the entire length of the road, which could be several dozens of miles.

The state-of-the-art method of installing fabric sheets, according to the "North Carolina Forestry BMP Manual", Appendix 4 at page 222 of 243 (amended 2006) publication date unknown, includes shaping the roadway and establishing the crown; rolling the fabric, weight the sides and end of the unrolled fabric with shovels full of gravel, or use spikes to pin the fabric down. This method, however, has certain drawbacks. One drawback includes puncturing the fabric with spikes or staples to pin the material: it is undesirable to puncture the fabric as this causes rips and tears in the sheet, and the punctures themselves enable the base layer to intermix with the aggregate layer, which weakens the roadbed. Manpower cost associated with shoveling aggregate on top of the unrolled sheet to weight it down is yet another drawback of this known method.

Certain devices are known to facilitate the laying of paving fabric along a roadbed. For example, U.S. Pat. No. 4,456,399 issued on 26 Jun. 1984 to Conover describes an apparatus for laying paving fabric comprising a core support member of an adjustable length for supporting a roll of paving fabric on a vehicle, a tension applying apparatus secured in the proximity of the fabric roll to remove wrinkles from the web prior to the application to the roadbed, and a broom apparatus for facilitating adherence of the web to the roadbed and a guard for the broom for reducing wrinkling of the fabric.

Yet, there remains a need for improved methods and devices that improve the installation of geotextiles and similar fabric rolls, particularly on temporary road-bed projects. Such tools and methods should minimize worker exposure to injury, reduce manpower required, and reduce expense of installation through time and manpower efficiencies. An improved device and method is needed that enables the unrolling of the fabric roll without requiring spikes to penetrate the fabric to pin the roll in place (as needed, for example, in windy conditions). It would further be desired to have a tool and method that improves efficiencies by combining the rolling of the fabric with the delivery of the aggregate. Such a device, in addition, should be easy to transport to the job site on existing vehicles. Further, such an improved device should be easy to assemble and disassemble by one person.

SUMMARY OF THE INVENTION

The present invention includes improved devices and methods to simultaneously unroll geotextile fabric and place aggregate on top, without requiring spikes or staples to pin the fabric in place.

In one preferred embodiment, the present invention consists of a conveyered material placement vehicle adapted to hold multiple widths and lengths of road bedding cloth or landscape cloth. The vehicle includes two receiver hitches welded, attached or otherwise coupled on opposite sides of the rear bumper, approximately seven feet between each other. The pair of receiver hitches slideably receive a corresponding square steel tube or round pipe having a through hole at one end, which enables the retaining pin of the receiver hitch to pass through the receiver hitch and the end of the steel tube when inserted in the hitch. The pair of horizontally disposed steel tubes protrude generally perpendicular from the rear bumper of the vehicle and serve as mounting arms for an approximately 16-foot length of square steel tubing (or similarly sized round pipe of about 2-inches in diameter) that serves as the hanger bar, which arranges generally parallel to the rear bumper of the vehicle and shares the vehicles centerline, but is offset from the rear bumper by a length determined by the pair of steel tubes, which are of a length to clear the device from the operation of the conveyered aggregate delivery apparatus mounted to the rear portion of the vehicle.

The hanger bar includes a pair of end caps and half links are welded to the end caps, and a pair of eye-loops are additionally welded to this bar. A segment of about 2-feet in length of chain hangs from each end cap half links. This pair of chain segments supports a roller bar, which has a round cross section and adapts to suspend a fabric roll and allows the roll to rotate freely on the bar. The roller bar is further adapted to receive varying lengths of fabric rolls by means of several positioned through-holes, which adapt to receive lock-pins. Thus, a pair of locking plates can be positioned on the roll bar, and secured from sliding by the locking pins, ensuring the fabric roll remains in fixed position relative to the vehicle centerline. The roller bar is pre-drilled at about 15-foot and about 13-foot lengths, which represent standard roll widths commonly used in road building.

A mesh assembly fabricated from about five about 16-feet to about 18-feet lengths of chain form the long (vehicle) axis of the grid, while about twelve segments of about 3.5-feet of chain create the cross axis of the grid. In stead of chain segments, a heavy cable could also be used to form the mesh grid. Similarly, a grid of solid or hollow metal bars or pipes could be arranged to drag on top of the fabric and, although not optimal for curves, the rigid grid members could serve the same function as the mesh assembly fabricated from chain segments.

A dragger bar adapts to accept the five long chains (or cable or rigid bar segments), thus dragging the dead-weight member behind the vehicle. The dragger bar is positioned to carry the chain on top of the fabric roll, weighting down the roll as it rests on the roller bar.

With receiver hitches, roller bar, hanger bar, cloth roll, and dragger bar with chains in place, the cloth is initially held down with the weight of the dragger bar chains as the conveyered material placement vehicle moves forward. The conveyered material placement vehicle then begins to place gravel on top of the cloth as it proceeds in a forward motion, driven via a remote controlled drive system. The conveyered gravel placed on top of the cloth keeps the cloth flat and firmly held on the subgrade even in windy conditions. The operator stops the truck when the roll is empty, un-clips the roller bar from the hanger bar, slides out the spent roll, places the new roll on the roller bar, lifts the dragger bar from the pair of L-hooks on the hanger bar and sets the dragger bar on the ground. Then, the new roll on the roller bar is re-clipped to the hanger bar, and the dragger bar is lifted back on the L-hooks, automatically positioning the dead-weight member on top of the new fabric roll.

A preferred embodiment of the present invention includes a device consisting of sub-components sized and weighted for one worker to remove from the vehicle when in the transport mode, assemble the components, attach the device to the receivers on the vehicle and disassemble when the job is complete.

DRAWING

DESCRIPTION OF THE INVENTION

Possible preferred embodiments will now be described with reference to the drawings and those skilled in the art will understand that alternative configurations and combinations of components may be substituted without subtracting from the invention. Also, in some figures certain components are omitted to more clearly illustrate the invention.

FIGS. 1-5 illustrate a first preferred embodiment of the present invention. The present invention includes a mechanical implement 10, specifically, for example, a device utilized to unroll and fixably locate a geotextile fabric for roadbed construction. The implement (device 10) adapts to couple to a rear portion of a vehicle frame (V), for example, a conveyered aggregate delivery vehicle, or more broadly a conveyered material placement vehicle, as used in roadbed construction, by cooperating with the vehicle's forward travel to unroll the fabric roll and incorporating a unique and novel dead-weight member 110, such as a heavy yet flexible cable, rope, tubes or assembly of chain segments arranged in a mesh grid assembly to weight the recently unrolled fabric on top of the prepared sub-grade.

Figure 1:
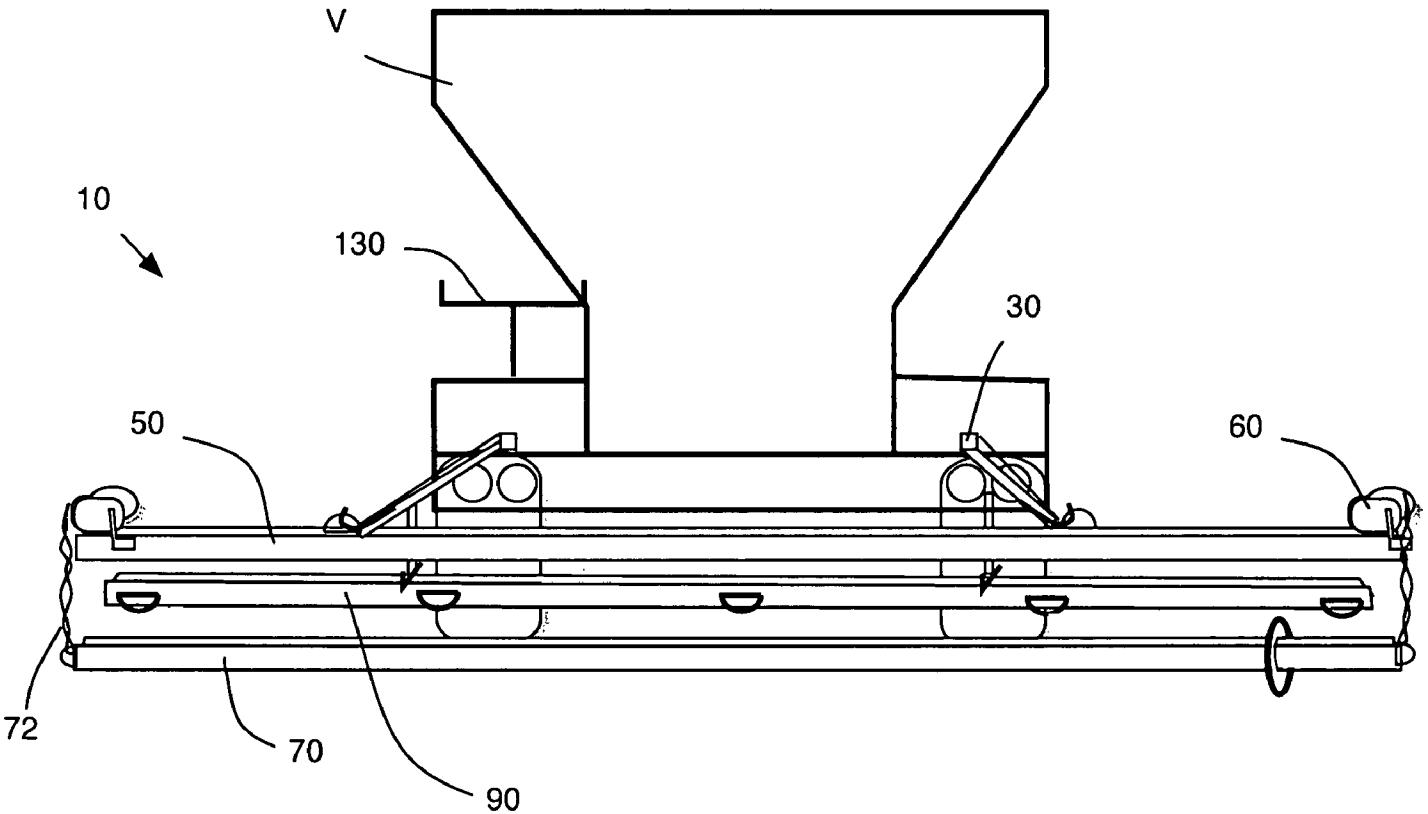
FIG. 1 is a front view of a preferred embodiment of the present invention.
Figure 2:
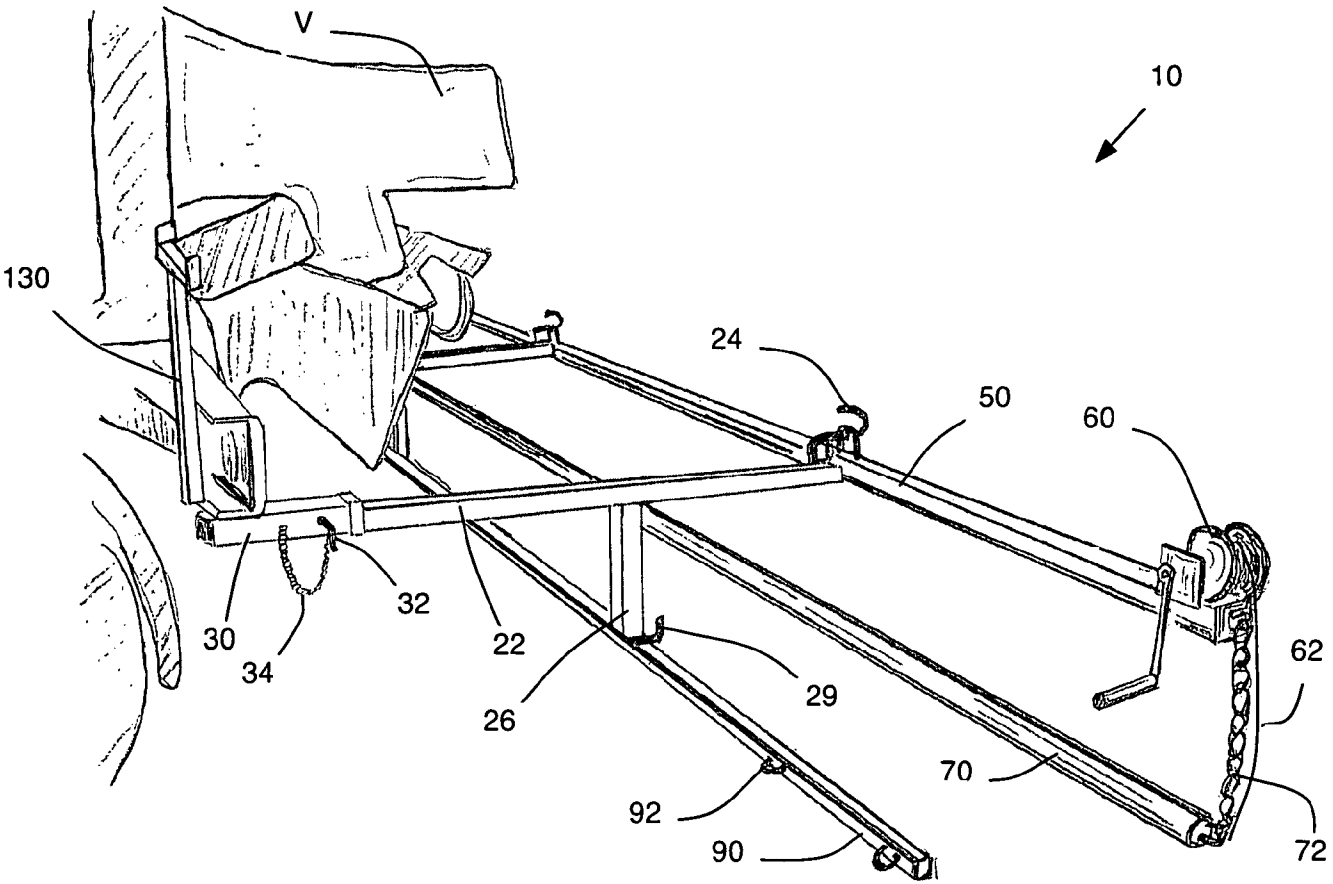
FIG. 2 is an off-set right-side view of the embodiment of FIG. 1.
Figure 3:
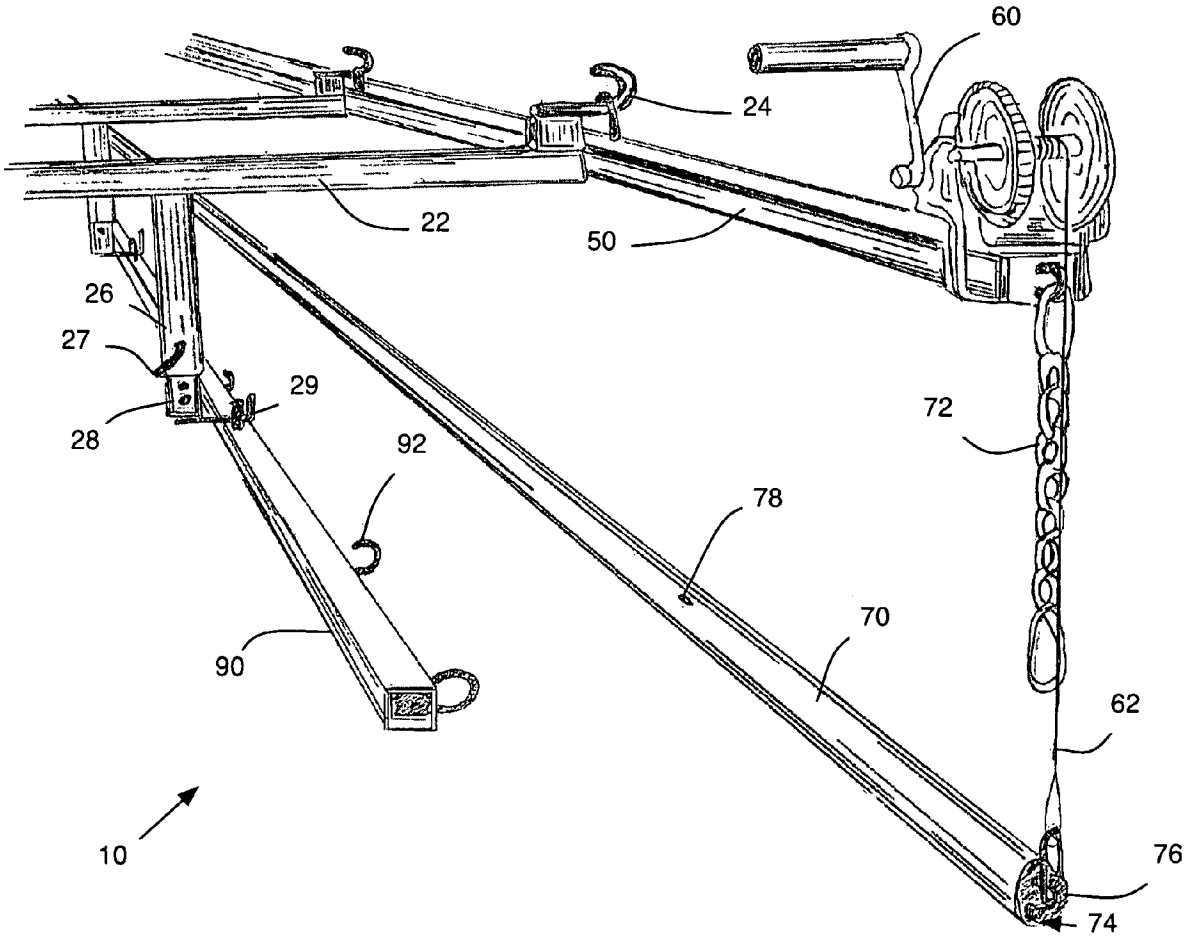
FIG. 3 is a partial, off-set right-side view of the embodiment of FIG. 1.
Figure 4:
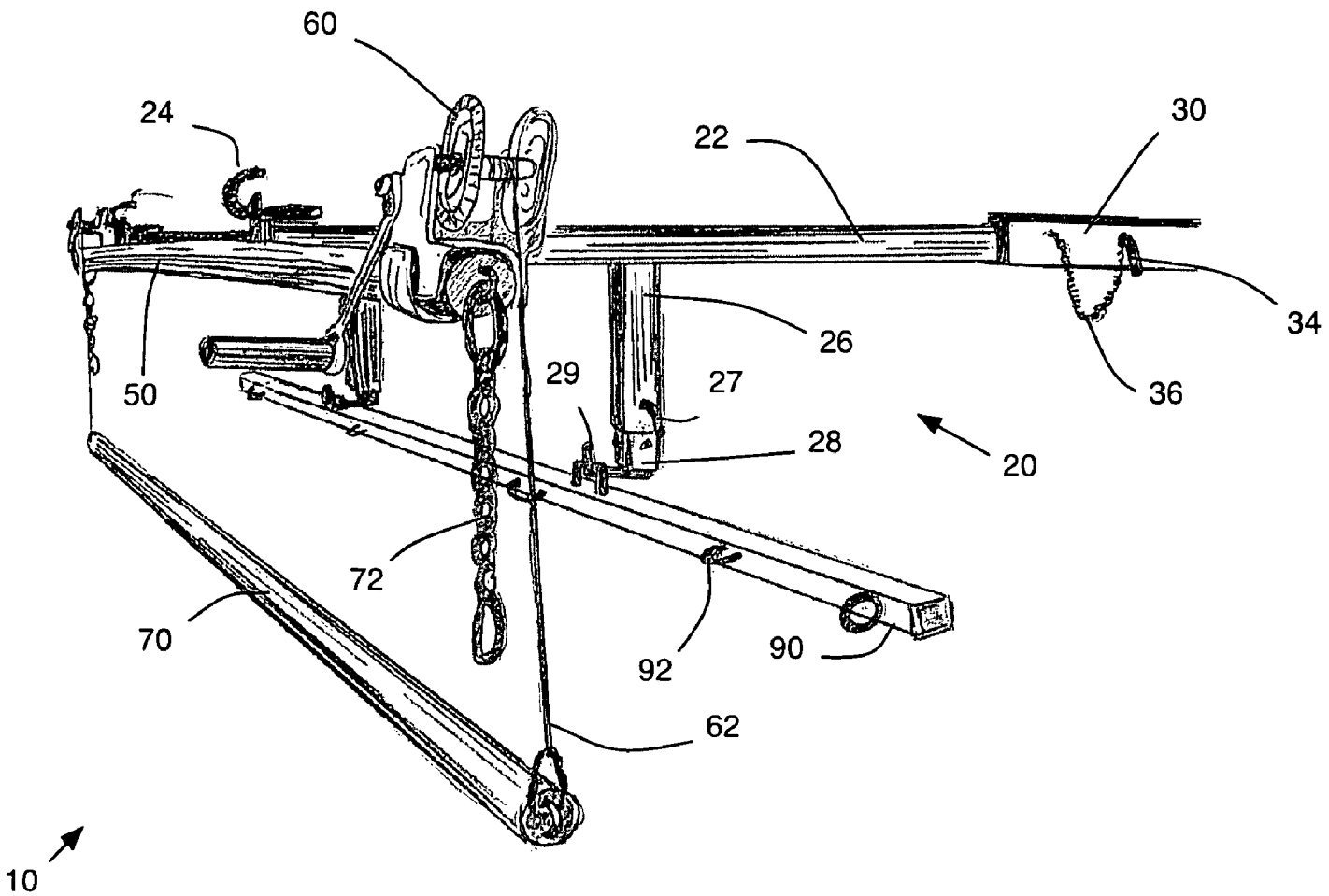
FIG. 4 is an off-set left-side view of the embodiment of FIG. 1.
Figure 5:
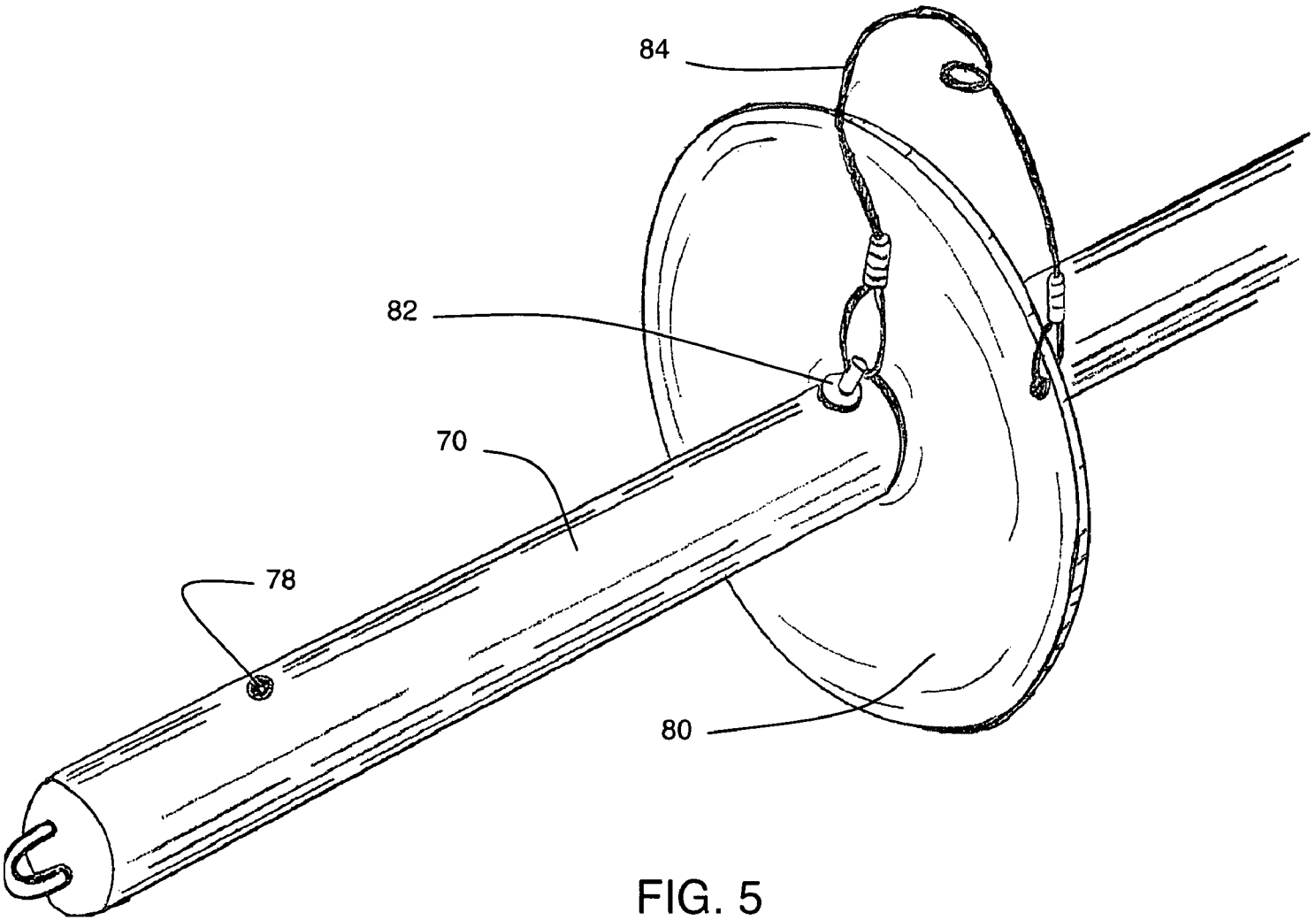
FIG. 5 is a partial detail view of a component of a preferred embodiment of the present invention.
Figure 6:
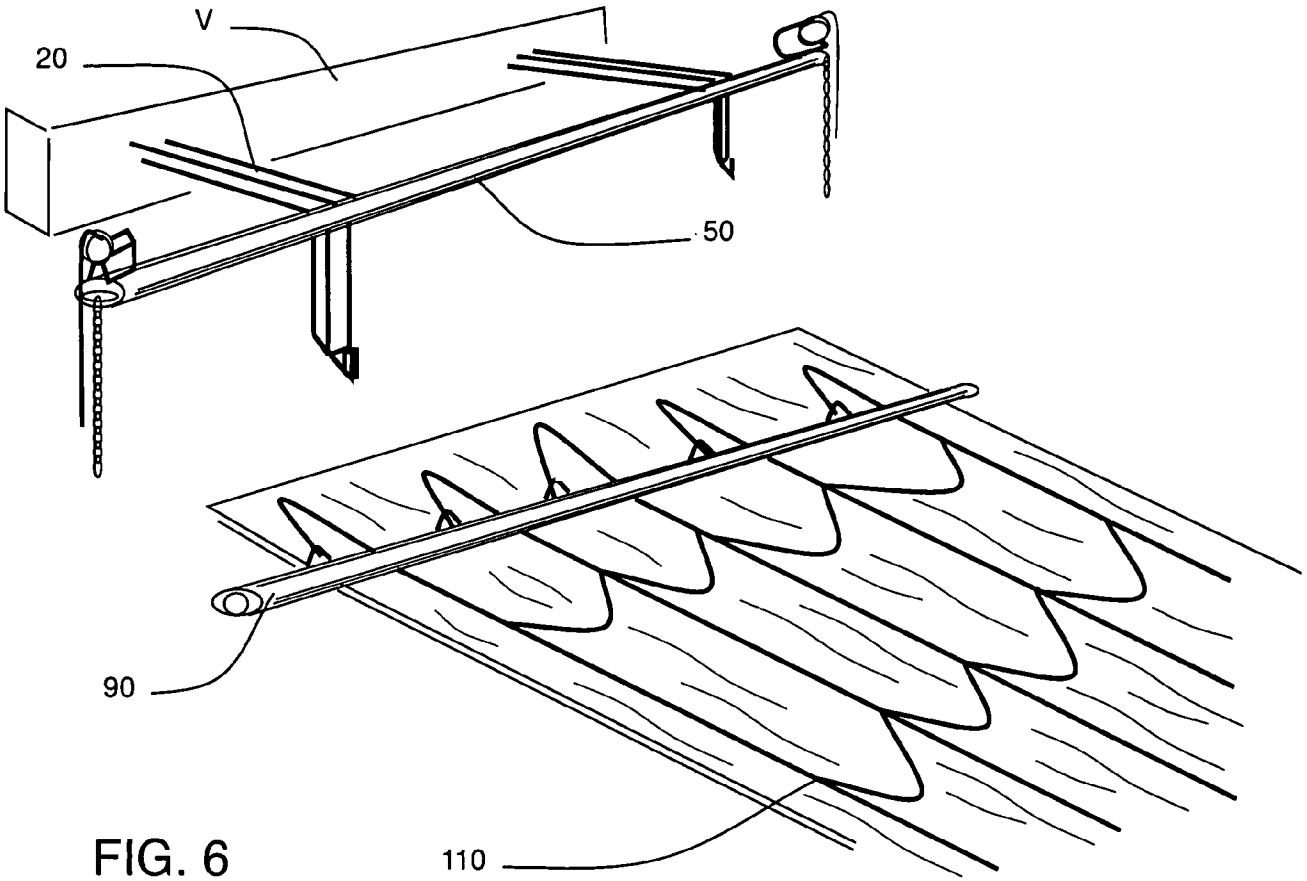
FIG. 6 is an off-set frontal view of one embodiment of the present invention and shows a step according to a preferred method of the present invention.
Figure 7:
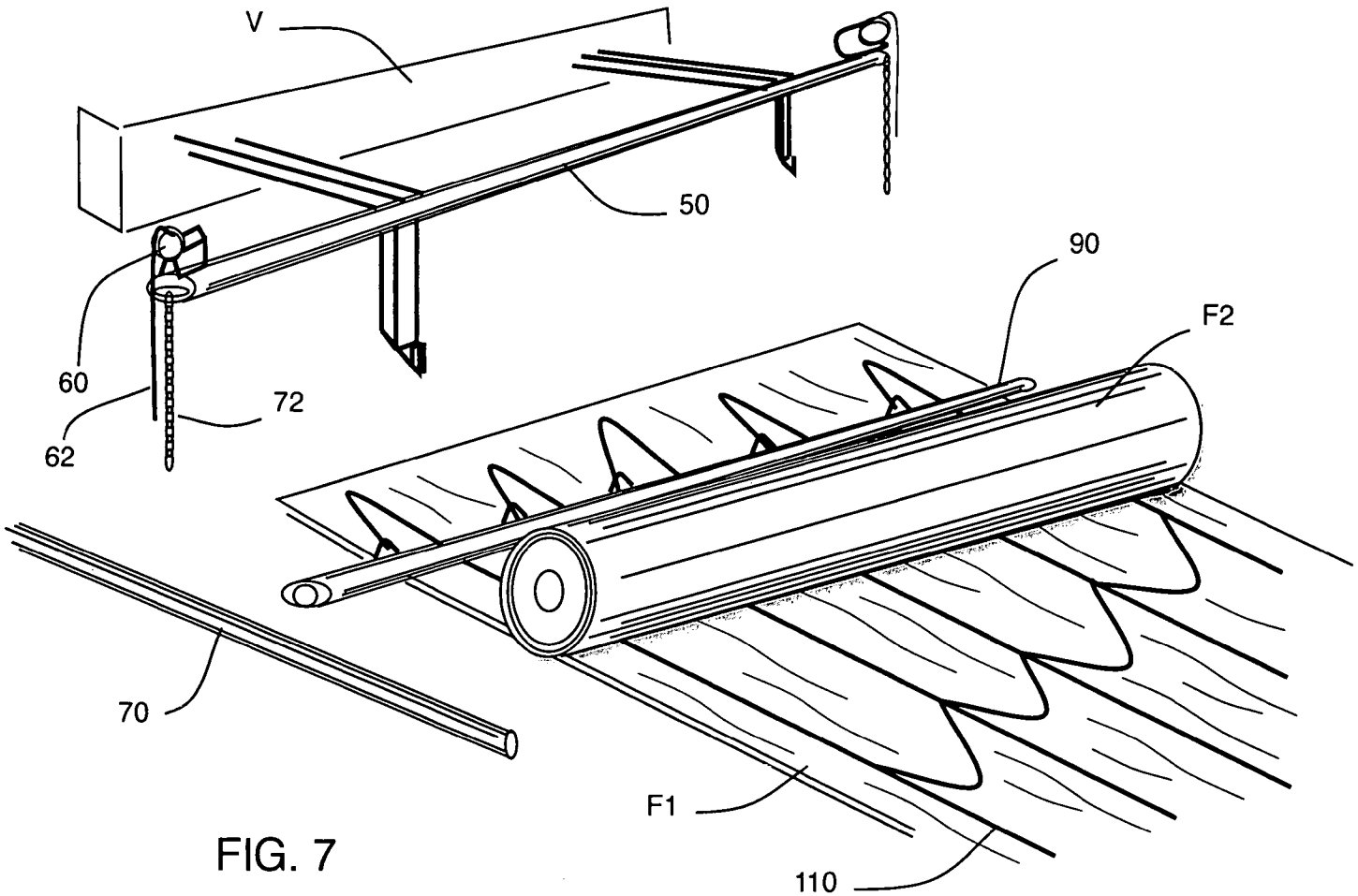
FIG. 7 is an off-set right side view of one embodiment of the present invention and shows another step according to a preferred method of the present invention.
Figure 8:
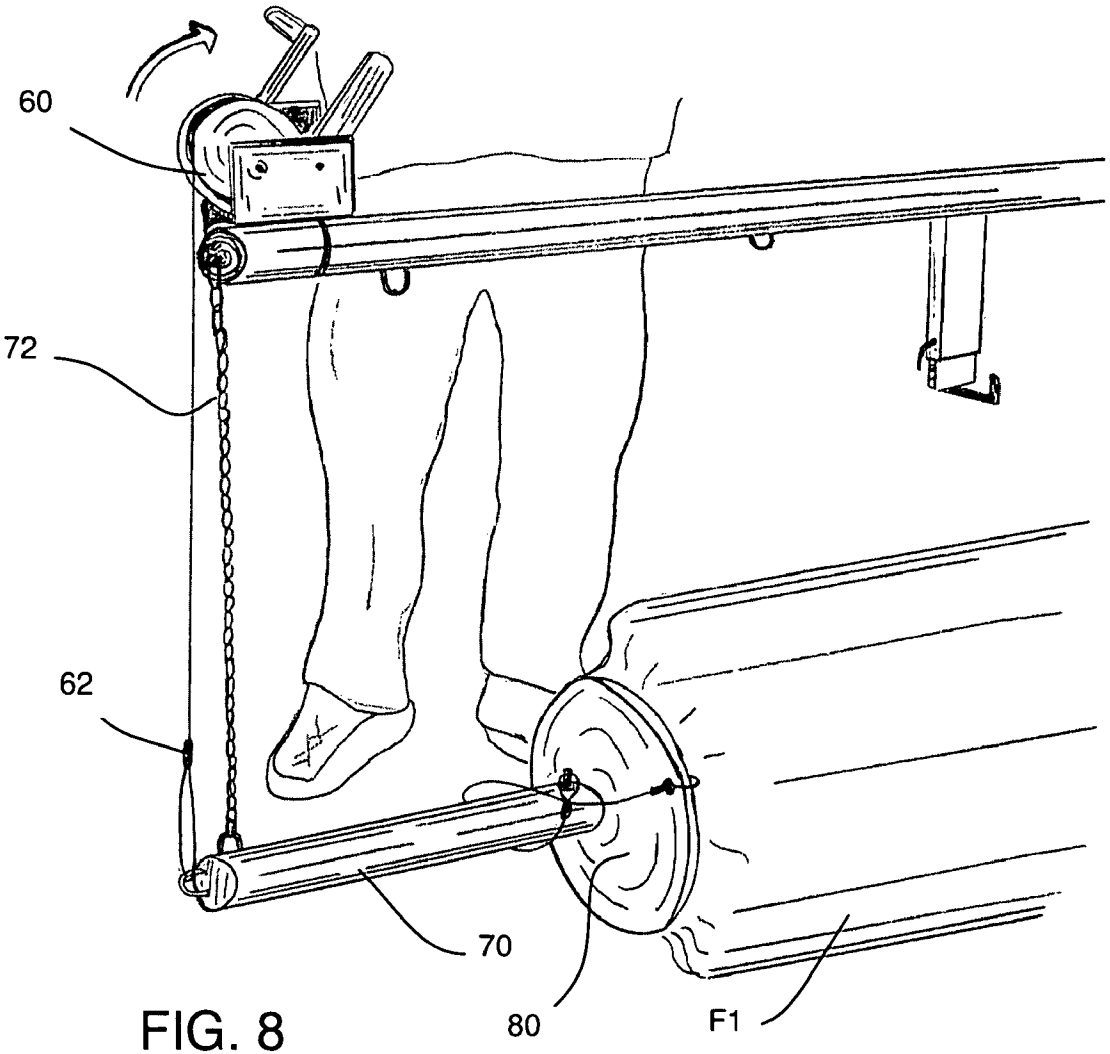
FIG. 8 is a partial front view of one embodiment of the present invention and shows another step according to a preferred method of the present invention.
Figure 9:
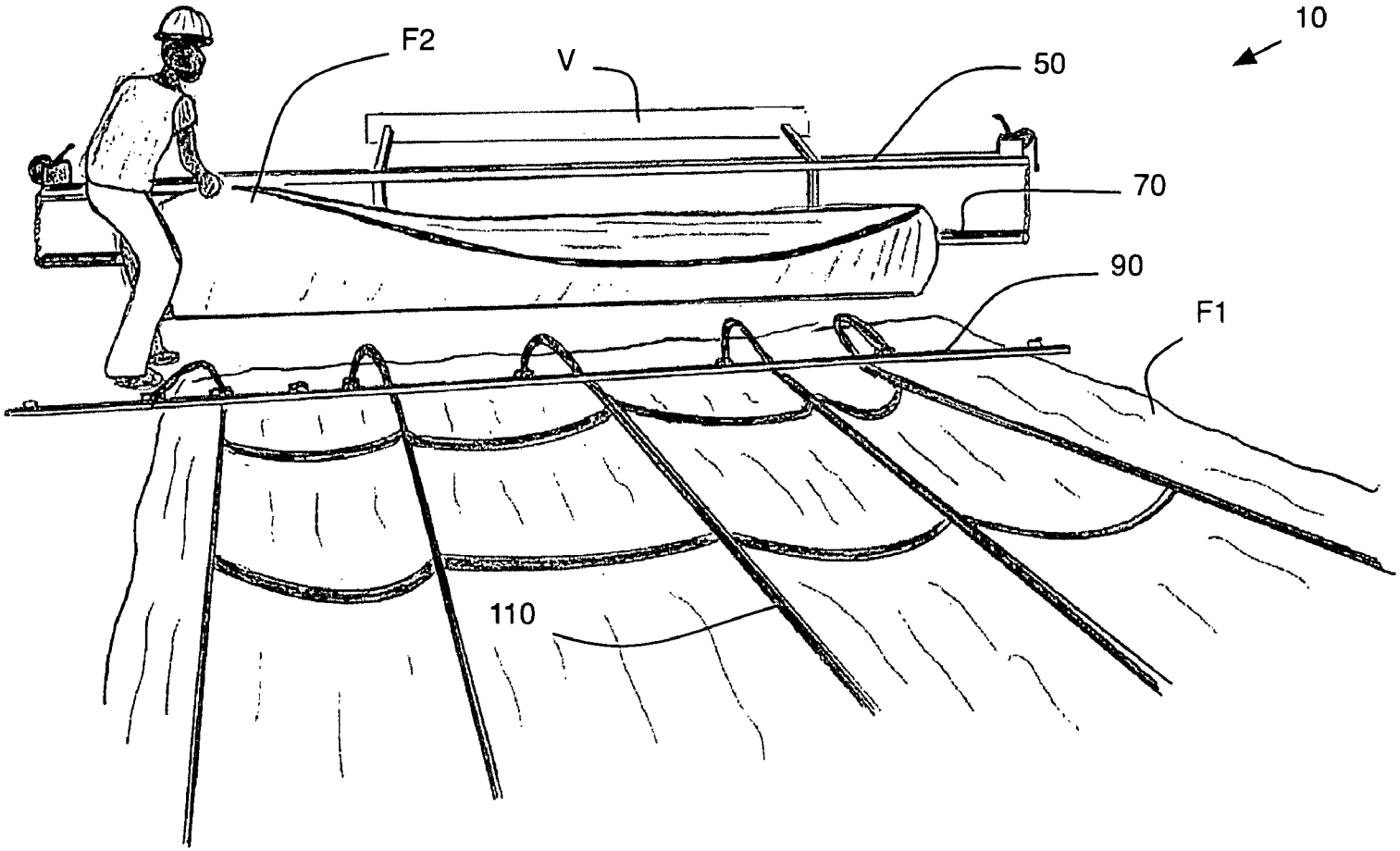
FIG. 9 is a front view of one embodiment of the present invention and shows another step according to a preferred method of the present invention.
Figure 10:
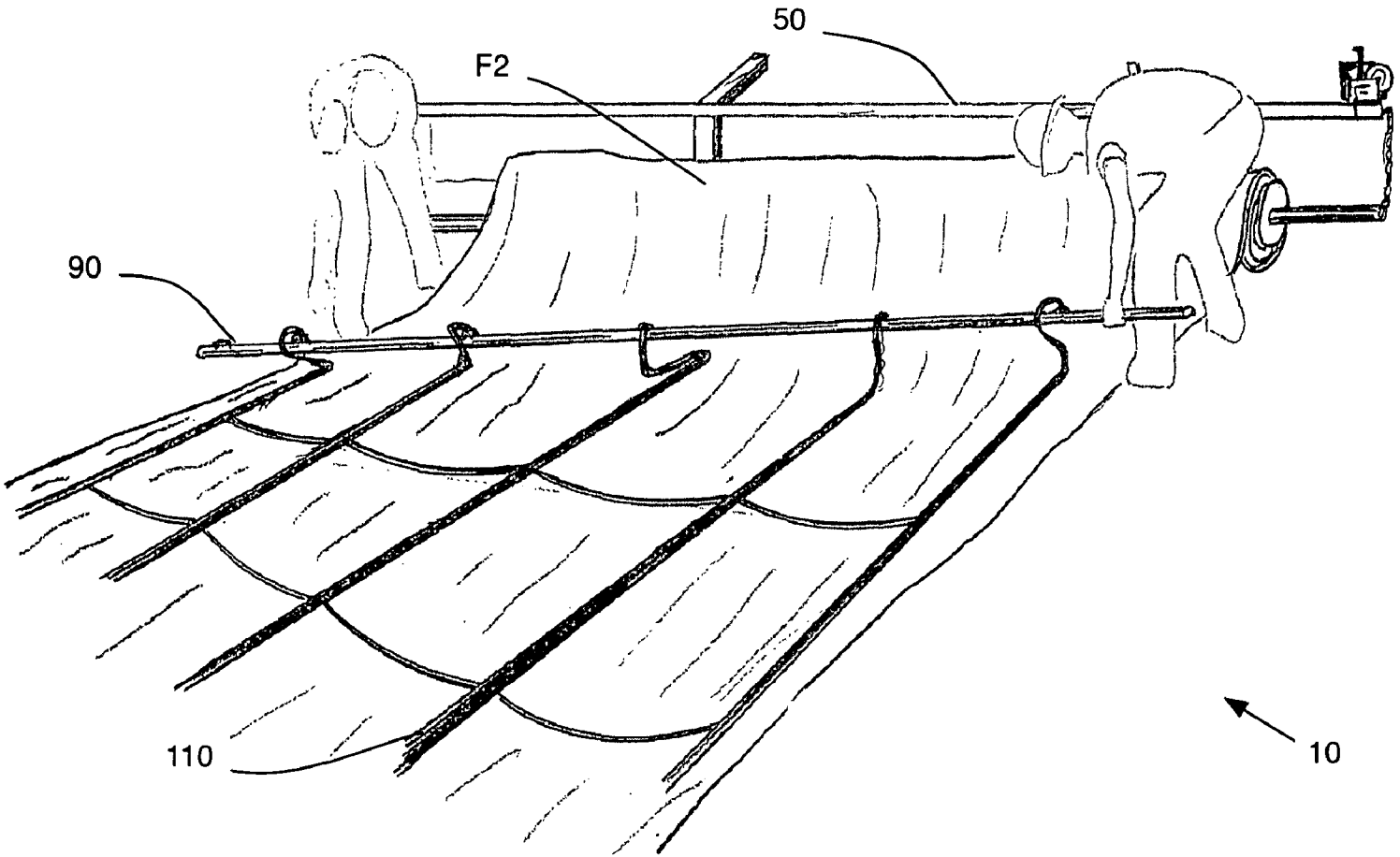
FIG. 10 is an off-set frontal view of one embodiment of the present invention and shows another step according to a preferred method of the present invention.
Figure 11:
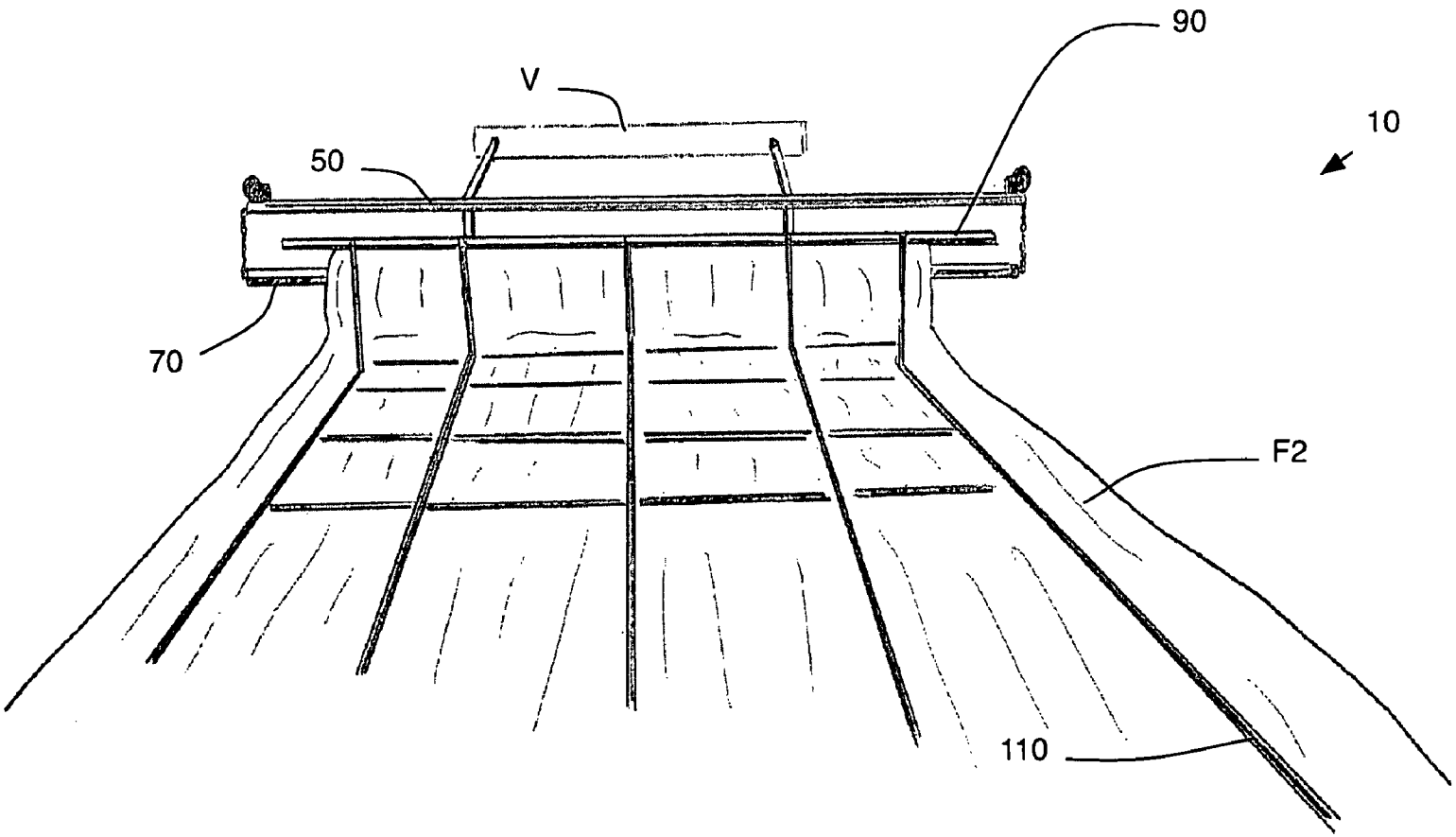
FIG. 11 is a front view of one embodiment of the present invention and shows another step according to a preferred method of the present invention.

FIG. 1, a front view of a preferred embodiment of the present invention, illustrates most of the major components including a support frame including a stinger member 20, which releasable couples to the vehicle frame V and carries the principal horizontal support or hanger bar 50. The support frame further includes a hanger bar arranged generally perpendicular to the long-axis of the vehicle frame and extending from about 6-feet to about 10 feet on each side of the vehicle's center line for a total length from about 12-feet to about 20-feet. The hanger bar includes a pair of oppositely mounted winches 60 on each extremity of the length of the bar. The winches enable workers to position and lift the relatively heavy rolls of fabric (once located on the roller bar 70, discussed below) relative to the hanger bar and determines the height of the roll from the ground and relative to the vehicle frame. Further, opposite ends of the hanger bar each include a chain loop or hook 52 (or other attaching means) from which a first and second chain segment 72 suspends.

The chain segments 72, in turn, support a roller bar 70. The roller bar supports rolls of geotextile fabric as generally understood in this art. The roller bar releasably couples to the chain segments 72 at a corresponding first and second roller-bar end, each end has a corresponding end cap 74 with half-link 76 chain support means (such as a hook, receiver, quick-connect, or other coupling means) adapted to enable the chain segments 72 to attach and un-attach as needed to swap a spent roll for a new roll of fabric. Additionally, a winch cable 62 from the pair of winches 60 on the hanger bar 50 equally releasably attach to the roller bar by means of the half-links 76.

Also suspended from the stinger assembly 20, a dragger bar 90 arranges generally parallel to the roller bar 70, and positions intermediately between the vehicle and the roller bar. The dragger bar includes a plurality of attaching means 92 consisting of hooks or half-links or chain, or other similar device adapted to selectively and releasably couple a link of chain to the dragger bar. A dead-weight member 110 adapts to couple (not shown in FIGS. 1-5) to the dragger bar at the attaching means 92. Thus, the dead-weight member positions over the roll of fabric located on the roller bar (the roll of fabric is not shown in FIGS. 1-5) and extends rearward beyond the vehicle.

In the various embodiments and figures, the long horizontal members, specifically, the hanger bar 50, the roller bar 70 and the dragger bar 90 are depicted as rigid members, solid with hollow centers having a fixed length. However, those skilled in the art will appreciate that these horizontal members may have a solid core or, alternatively, may include telescoping features to enable the bars to extend and retract to various desired lengths corresponding to transport of the device, or as needed for varying widths of the road bed, fabric roll, or application of use, for example.

For example, the hanger bar 50, in another preferred embodiment (not illustrated in the accompanying figures) comprises a hanger member coupled to the vehicle via stinger arms 22. The hanger member has an length of about 8-feet to about 10-feet long, or about the width of the vehicle to which it attaches. The hanger member further is adapted to receive a first and second hanger arm at opposite ends of the hanger member: Accordingly, the hanger member may be solid, with the arms inserting over the bar, or, preferably, the hanger member has a hollow core, and the arms slide inside a portion of the exposed ends of the member. The member is further configured with several though holes, arranged to correspond to similar through holes in the associated hanger arm so that a retaining pin can fixably secure the arm inside the member. In addition, the at least one hanger arm (adapted to slidebly engage a portion of the hanger member) effectively provides an adjustable and variable length hanger bar from which the roll bar suspends. It will be appreciated by those skilled in the art that this embodiment enables a geotextile roll to be positioned off-center from the vehicle, or on center with the vehicle, as needed by the application. Further, should a more narrow installation process be involved, for example, re-paving a single vehicle lane on an existing roadway or installing a geotextile roll in a roadside ditch, the present invention more readily adapts to this use.

Making general reference to FIGS. 1-11, details of preferred embodiments of the present invention are further discussed, below. In one preferred embodiment, a geotextile-roll applicator device 10 for a vehicle frame V comprises a means for coupling the device to the vehicle frame, such as a stinger member 20 and pair of receiver hitches 30. The receiver hitches 30 mount to the vehicle frame by any means well understood in this art including, but not limited to, welding to the frame of the vehicle. A suitable receiving hitch 30 includes a standard square receiver commonly available for tow-hitch applications as understood in this art. The stinger member 20 slideably inserts into the receiver hitch and a hitch pin 32 engages a through-hole in the stinger member and receiver hitch, while a pin chain prevents misplacing the pin when not inserted in the hole.

The stinger member 20 consists of a pair of horizontal stinger arms 22 arranged generally parallel to the long-axis of the vehicle and extending outward from the rear portion of the vehicle. Each stinger arm 22 includes a first arm-end adapted to slideably insert into the respective receiver hitch, an oppositely disposed second arm-end including a connecting means such as a U-shaped hook 24 (or other similar releasably coupling apparatus or means), and a vertically arranged holder leg 26 disposed intermediate to the first and second arm ends at holder-leg first end. The holder-leg 26 further includes a holder-leg extension member 28 adapted to slideably engage the holder-leg at a holder-leg second end and a pin cooperating with pin-receiving holes aligned on both the extension and leg locates and secures the extension relative to the leg. A connecting member, such as an L-shaped hook 29, locates at the free end of the extension 28. This L-shaped hook adapts to receive the dragger bar 90, discussed below. Thus, the position of the L-shaped hook relative to the ground, vehicle, and importantly, to the roller bar 70 can be adjusted by sliding the extension member 28 in or out of the leg 26 and securing the desired position with the pin 27.

The roller bar 70 suspends below the hanger bar 50 by a first and second suspension means consisting of two oppositely positioned and cooperating chain segments 72. The roller bar adapts to support a roll of geotextile fabric and enables the roll to rotate on its roll-axis to dispense the fabric conventionally. The roll bar, in one preferred embodiment, includes a circular cross section, however a square cross section, oval, elliptical or rectangular cross section will work as well. A spacer plate 80, or preferably a pair of spacer plates adapt to arrange on the roller bar and lock into position by a locking means for selectively and releasably coupling the spacer plate in a first fixed position on the roller bar. The locking means comprises a pair of spacer pins 82 that cooperate with features on the roller bar. The spacer plate enables locating the roll of fabric in a particular position relative to the center-line of the vehicle and maintains the roll in that desired position as the vehicle travels forward. Accordingly, the roll of fabric can be placed in the center, as required for a roadbed, or off center as may be required to lay fabric for a drainage ditch or retaining wall, for example. In a preferred embodiment, the roll-bar has pre-arranged pin-receiving holes at about 13-feet between cooperating holes and at about 15 feet, representing two standard widths of roll fabric. Additionally, each pin attaches to a cable coupled to its corresponding plate 80 to avoid loosing the pin when not inserted in the roller bar.

In one preferred embodiment, the hanger bar 50 carries a pair of cooperating and oppositely positioned winches 60. However, in other preferred embodiments the winches may be omitted without detracting from the invention. Additionally, the accompanying figures illustrate a set of hand-operated winches: However, electric or hydraulic-powered winches would work equally well. Each winch includes a winch cable 62 that selectively couples to the roller bar. Then, by cranking the winch handle, the loaded roller bar can be positioned relative to the hanger bar and the chain segments 72 are attached to carry the load and the winch cable can be released and retracted for subsequent use.

A dead-weight member 110 having a generally grid-like layout comprising interconnected segments of chain loops, releasably couples to the dragger bar 90. The dead-weight member consists of five generally parallel drag chains measuring about 15-feet to about 25-feet (preferably about 18-feet) in length and extending from the dragger bar behind the vehicle. At a spacing of about 2-feet to about 4-feet (preferably about 3.5 feet), each drag-chain includes a cross-member link chain. Thus, a grid pattern of about a 3.5-foot square grid with five columns is formed. This grid can, alternatively, be formed from cables or bar-segments in lieu of chains.

FIGS. 6-11 illustrate a first preferred method of using the device 10 of the present invention. Accordingly, this preferred method for dispensing a roll of geotextile fabric using a conveyered aggregate delivery vehicle having a frame adapted to couple to a geotextile roll applicator device, the method comprises: providing a geotextile roll; unrolling a portion of the geotextile; placing a dead-weight member provided by the applicator device over the roll and extending the dead-weight member onto the portion of unrolled geotextile; dispensing an amount of aggregate using the conveyered aggregate delivery vehicle; and advancing the vehicle forward thus causing the geotextile roll to unroll and the dead-weight member to drag on top of the newly unrolled geotextile and continuing dispensing aggregate as the vehicle advances forward.

Additionally, this method further includes steps of providing a remote control drive system for the vehicle and advancing forward the vehicle with the remote control drive system.

In another preferred embodiment, the present invention contemplates a system for dispensing geotextile fabric. The system comprises a vehicle having an aggregate dispensing mechanism that is operable to dispense aggregate from one end of the vehicle; and a geotextile-roll applicator device coupled to the vehicle adjacent the end from which aggregate is dispensed, the applicator device being configured to support a roll of geotextile fabric and dispense the fabric from the roll; wherein when the vehicle is moved along a path, the applicator device is operable to dispense fabric onto the ground along the path and the aggregate dispensing mechanism is operable to dispense aggregate from the vehicle onto the dispensed fabric.

Figure 12:
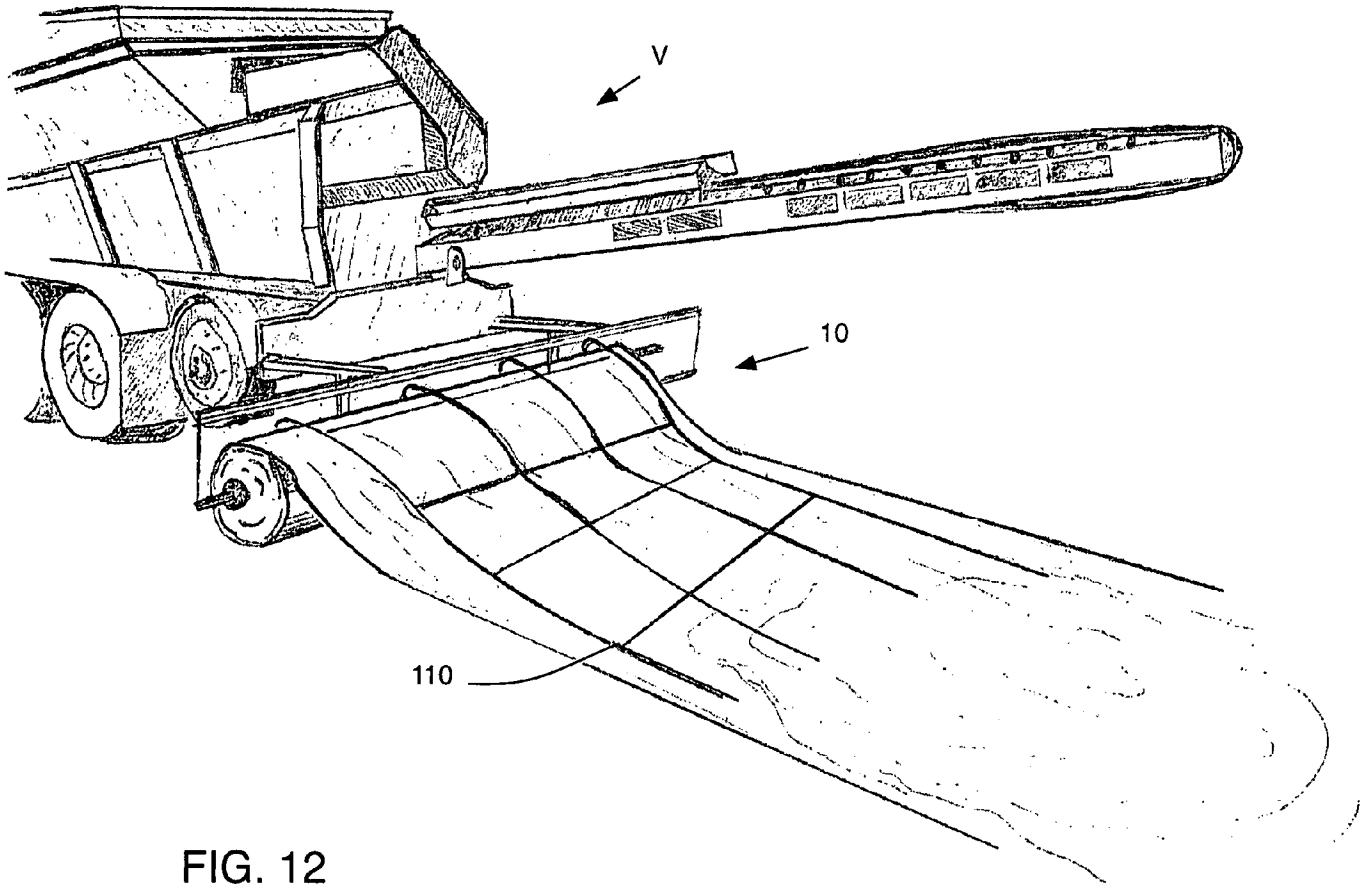
FIG. 12 is a possible environment of use of one embodiment of the present invention and depicts an aggregate delivery vehicle dispensing aggregate onto a fabric roll on a roadbed.

FIG. 12 illustrates another preferred method of the present invention includes a method for dispensing geotextile fabric from a roll. The method includes the steps of supporting the roll of fabric on an applicator device, which is coupled to a vehicle; moving the vehicle along a path; and dispensing fabric from the roll onto the ground along the path as the vehicle is moved and simultaneously dispensing aggregate from the vehicle onto the dispensed fabric.

When the device 10 is not in use, for example, when it is being transported to and from a job site, the entire device dis-assembles and compactly stores on the vehicle by means of a T-rack 130. The T-rack adapts to insert in a receiver hitch arranged vertically on the vehicle frame. The T-rack cooperates with the conveyer rack provided by the vehicle.

The various components of the preferred embodiments of the present invention are generally about 1-inch to about 2-inch square or round tube steel members welded or bolted, as conventionally understood in the art, or—as described herein—adapted to releasably couple to mating components by hooks or other fasteners as described or as would be generally understood in this art. And, although steel is contemplated, other materials would work equally well including aluminum, for example. Further, the various embodiments of the present invention and methods show a material placement vehicle (such as a conveyered aggregrate delivery truck, such as a Super Stone Slinger brand aggregate delivery vehicle available from W.K. Dahms Mfg. Ltd., of St. Jacobs, Ontario, Canada), it will be appreciated by those skilled in this art that other vehicles—including side-dump, belly-dump, or rear dump trucks—can be adapted to work with the device 10, and may only require additional manpower or equipment to distribute aggregate on top of the unfurled geotextile.

Although the invention has been particularly shown and described with reference to certain embodiments, it will be understood by those skilled in the art that various changes in form and detail may be made without departing from the spirit and scope of the invention.

I claim:

1. A geotextile-roll applicator device for coupling to a vehicle frame, the device comprising:

a support frame;

a roller bar supported by the support frame and adapted to receive a roll of geotextile fabric; and a dead-weight member supported by the support frame and configured to extend over and weigh-down a portion of the geotextile fabric that is dispensed from the roll; and wherein the support frame comprises:

a first and second receiver hitch coupled to the vehicle frame;

a first and second stinger member, each stinger member respectively comprising a stinger arm having a first arm-end adapted to slideably insert into the respective receiver hitch, an oppositely disposed second arm-end including a connecting means, and holder leg disposed intermediate to the first and second arm ends at a holder-leg first end;

a hanger bar coupled to the first and second stinger members;

a dragger bar adapted to couple to the hanger bar, the dragger bar further comprising a plurality of attaching members; and wherein the hanger bar further comprises:

a first winch means for selectively positioning the roller bar relative to the support frame.

2. The device of claim 1 wherein the first stinger member further comprises:

a holder-leg extension member adapted to slideably engage the holder-leg at a holder-leg second end;

a retention pin and cooperating retention pin first through hole extending through the holder leg second end and a corresponding pin second through hole extending through the holder-leg extension member whereby the retention pin selectively engages the holder leg in fixed position relative to the extension leg; and wherein the connecting means comprises a connecting member coupled to the holder-leg extension member.

3. The device of claim 1 further comprising:

a spacer plate adapted to slideably engage the roller bar; and a locking means for selectively and releasably coupling the spacer plate in a first fixed position on the roller bar.

4. The device of claim 1 wherein the hanger bar further comprises:

a second winch means for selectively positioning the roller bar relative to the support frame.

5. The device of claim 1 wherein the support member further comprises:

a hanger bar comprising a hanger member coupled to the vehicle and at least one hanger arm adapted to slidebly engage a portion of the hanger member whereby an effective hanger member length is variably adjustable, the hanger arm further adapted to suspend at least one end of the roller bar.

6. The geotextile-roll applicator device of claim 1 further comprising:

a dragger bar adapted to be supported by the support frame, the dragger bar further adapted to support the dead-weight member.

7. A geotextile roll applicator device adapted to couple to a vehicle frame, the device comprising:

a support frame;

a roller bar supported by the support frame and adapted to receive a roll of geotextile fabric;

a dead-weight member supported by the support frame and configured to extend over and weigh-down a portion of the geotextile fabric that is dispensed from the roll; and the support frame further comprising a first and second stinger member, each stinger member respectively comprising a stinger arm having a first arm-end adapted to couple the vehicle frame, an oppositely disposed second arm-end including a connecting means, and holder leg disposed intermediate to the first and second arm ends at a holder-leg first end;

a hanger bar having a first and second eyelet, each eyelet adapted to releasable couple to the connecting means provided by the corresponding stinger arm to support the hanger bar from the corresponding connecting means, the hanger bar further comprising a first and second chain-loop disposed on opposite ends of the hanger bar and adapted to receive a corresponding segment of roller-bar chain;

a roller bar suspended from the first and second segments of roller-bar chain presented by the hanger bar, the roller bar further adapted to slideably receive the geotexitle roll;

a dragger bar coupled to the holder leg at a holder-leg second end, the dragger bar further comprising a plurality of eyelets disposed along a length of the bar; and a dead-weight member adapted to couple to at least a portion of the plurality of eyelets disposed along the dragger bar.

* * * * *